US006695061B2

(12) United States Patent
Fripp et al.

(10) Patent No.: US 6,695,061 B2
(45) Date of Patent: Feb. 24, 2004

(54) DOWNHOLE TOOL ACTUATING APPARATUS AND METHOD THAT UTILIZES A GAS ABSORPTIVE MATERIAL

(75) Inventors: Michael L. Fripp, Carrollton, TX (US); Neal G. Skinner, Lewisville, TX (US); Roger L. Schultz, Aubrey, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/083,818

(22) Filed: Feb. 27, 2002

(65) Prior Publication Data

US 2003/0159829 A1 Aug. 28, 2003

(51) Int. Cl.[7] ..... E21B 34/06; E21B 23/06; F04B 47/00; F03G 7/06

(52) U.S. Cl. ..... 166/373; 166/319; 166/187; 251/11; 60/528; 60/641.2

(58) Field of Search ..... 166/373, 319, 166/187; 251/11; 60/527, 528, 641.2

(56) References Cited

U.S. PATENT DOCUMENTS

| | | | | | |
|---|---|---|---|---|---|
| 3,504,494 | A | * | 4/1970 | Winsche | 60/645 |
| 4,004,642 | A | * | 1/1977 | Dardick | 175/4.5 |
| 4,016,722 | A | * | 4/1977 | Niederer, Sr. | 60/531 |
| 4,085,590 | A | * | 4/1978 | Powell et al. | 60/673 |
| 4,178,882 | A | * | 12/1979 | Anderson et al. | 123/1 A |
| 4,282,931 | A | * | 8/1981 | Golben | 169/61 |
| 4,375,239 | A | * | 3/1983 | Barrington et al. | 166/336 |
| 4,377,209 | A | * | 3/1983 | Golben | 169/26 |
| 4,385,494 | A | * | 5/1983 | Golben | 60/528 |
| 4,439,111 | A | * | 3/1984 | Seidel et al. | 417/379 |
| 4,512,721 | A | * | 4/1985 | Ayres et al. | 417/51 |
| 4,535,590 | A | * | 8/1985 | Jacobsen et al. | 60/531 |
| 4,784,320 | A | * | 11/1988 | Ford | 236/93 R |
| 4,856,595 | A | * | 8/1989 | Upchurch | 166/374 |
| 4,880,060 | A | * | 11/1989 | Schwendemann et al. | 166/336 |
| 4,884,953 | A | * | 12/1989 | Golben | 417/379 |
| 5,238,070 | A | * | 8/1993 | Schultz et al. | 166/386 |
| 5,485,884 | A | | 1/1996 | Hanley et al. | |
| 5,532,074 | A | | 7/1996 | Golben | |
| 5,573,307 | A | * | 11/1996 | Wilkinson et al. | 299/14 |
| 5,623,987 | A | | 4/1997 | Golben et al. | |
| 5,673,556 | A | | 10/1997 | Goldben et al. | |
| 5,688,611 | A | | 11/1997 | Golben | |
| 6,042,960 | A | | 3/2000 | DaCosta et al. | |
| 6,125,938 | A | * | 10/2000 | Garcia-Soule et al. | 166/344 |
| 6,128,904 | A | * | 10/2000 | Rosso et al. | 60/649 |
| 6,561,479 | B1 | * | 5/2003 | Eldridge | 251/11 |

OTHER PUBLICATIONS

"Hydrogen Technologies for the new Millennium", Ergenics, Inc. Presentation, dated May 1, 2001.

* cited by examiner

*Primary Examiner*—David Bagnell
*Assistant Examiner*—Thomas S Bomar
(74) *Attorney, Agent, or Firm*—Marlin R. Smith

(57) ABSTRACT

An actuator uses a gas absorptive material to produce displacement of a member of the actuator. In a described embodiment, an actuator includes a metal hydride powder. When the powder absorbs hydrogen gas, it expands and displaces a piston. When the powder discharges hydrogen gas, the powder contracts, displacing the piston in an opposite direction. Various methods of controlling gas absorption and discharge are provided.

67 Claims, 4 Drawing Sheets

DOWNHOLE TOOL ACTUATING APPARATUS AND METHOD THAT UTILIZES A GAS ABSORPTIVE MATERIAL

BACKGROUND

The present invention relates generally to actuators and, in an embodiment described herein, more particularly provides an actuator for a downhole tool.

Many types of actuator systems have been used for controlling operation of tools in subterranean wells. Some of the more common are hydraulic actuators which operate in response to pressure in control lines and electrical actuators which operate in response to signals transmitted via wires.

Each of these has enjoyed success in appropriate circumstances. However, each also has its drawbacks which prevent its use in other circumstances, or which prevent more widespread use of the system. For example, downhole hydraulic actuators which use control lines to transmit pressure from the surface typically require large pressures to be transmitted to overcome flow resistance in the control lines, compensate for hydrostatic pressure in the control lines, etc. As another example, downhole electrical actuators which use wires to transmit electrical power from the surface are limited in the amount of electrical power that can be transmitted by the wires due, for instance, to the electrical resistance of the wires.

What is needed is an actuator system which may be reliably operated downhole, and which does not require transmission of high pressures or large amounts of electrical power for its operation.

SUMMARY

In carrying out the principles of the present invention, in accordance with an embodiment thereof, an actuator system is provided which utilizes a gas absorptive material. The gas absorptive material expands when it absorbs gas and contracts when it discharges gas. Associated actuation methods are also provided.

In one aspect of the invention, an actuator is provided which includes a metal hydride powder in a chamber. When hydrogen gas is introduced into the chamber, the powder absorbs the gas and expands. Expansion of the powder may be used to displace a member, such as a piston of the actuator. Displacement of the piston may be used to displace a fluid to actuate a device, such as a downhole tool.

In another aspect of the invention, absorption of gas by the gas absorptive material and discharge of gas from the gas absorptive material may be controlled in various manners. For example, a gas flow controller may be used to control the flow of gas between the chamber and a gas storage device. The gas flow controller may be a valve connected between the gas storage device and the chamber, or it may be a heating device.

A heating device may be used to control flow of gas in different ways. For example, heating the gas absorptive material may cause it to discharge gas. As another example, the gas storage device may include a gas storing material which, when heated, discharges gas. Thus, gas may be made to flow in a desired direction by heating either the gas absorptive material or the gas storing material.

In yet another aspect of the invention, contraction of the gas absorptive material due to discharge of gas as a result of an increase in temperature of the gas absorptive material may be used to operate mechanisms in unique manners. For example, the gas absorptive material may have an expanded volume at the surface due to absorption of gas therein. However, when the material is positioned in a well, the increased temperature in the well may cause the gas absorptive material to discharge the gas, resulting in the material contracting in volume. This contraction of the material may be used to operate a downhole device. The use of well temperature to contract the material ensures that the device will not be operated at the surface.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
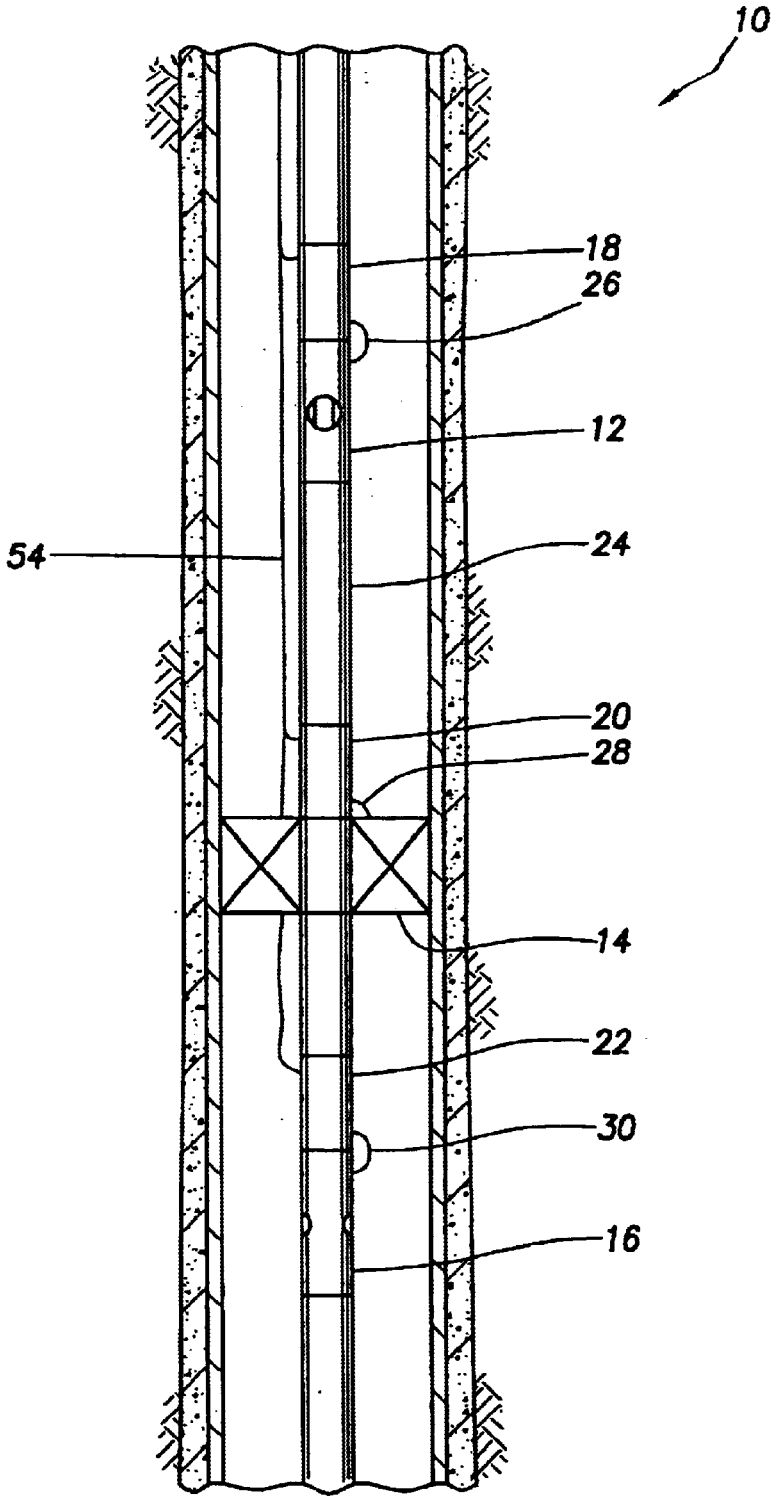
FIG. 1 is a partially cross-sectional view of a method of actuating downhole tools, the method embodying principles of the present invention.

Representatively illustrated in FIG. 1 is a method 10 which embodies principles of the present invention. In the following description of the method lo and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, several representative downhole tools 12, 14, 16 are operated using actuators 18, 20, 22, respectively, in a subterranean well. The actuators 18, 20, 22 are controlled in a unique manner which makes them particularly suitable for use in a downhole environment. However, it is to be clearly understood that the actuators 18, 20, 22 could be used in other environments, such as at the surface, without departing from the principles of the invention.

The tool 12 is a safety valve which controls fluid flow through a tubing string 24. A hydraulic line 26 connects the actuator 18 to the valve 12. While a certain level of pressure is maintained on the line 26 by the actuator 18, the valve 12 remains open, but when the pressure falls below that level, the valve closes.

The tool 14 is a packer. A hydraulic line 28 connects the actuator 20 to the packer 14. When it is desired to set the packer 14, the actuator 20 applies a certain level of pressure to the line 28, causing the packer to set. Such hydraulically set packers are well known to those skilled in the art, some of which are known as control line set packers.

The tool 16 is a production valve, and may be of the type known to those skilled in the art as a sliding sleeve valve. One or more lines 30 connect the actuator 22 to the valve 16. When it is desired to open the valve 16 the actuator 22 applies pressure to one of the lines 30, and when it is desired to close the valve the actuator applies pressure to another one of the lines.

Alternatively, the actuator 22 could apply pressure to one of the lines 30 to open the valve 16, and release this pressure to close the valve. As another alternative, the actuator 22 could apply pressure to one of the lines 30 to accomplish a one-shot opening or closing of the valve.

It will be readily appreciated that various other ways of actuating the tools 12, 14, 16 could be used. For example, instead of applying or releasing pressure on the lines 26, 28, 30, there could be a mechanical connection between each of the actuators 18, 20, 22 and the respective tools 12, 14, 16. As specific examples, the actuator 18 could displace an opening prong of the safety valve 12, the actuator 20 could displace a setting mandrel of the packer 14, and the actuator 22 could displace a sliding sleeve of the valve 16.

Basically, then, each of the actuators 18, 20, 22 displaces a fluid or a member to operate the respective tools 12, 14, 16. Of course, these are not the only ways in which displacement in an actuator can be used to operate a device. Therefore, it is to be clearly understood that any manner in which displacement in an actuator can be used to operate a device may be used, without departing from the principles of the invention.

One or more lines 54 may extend from a remote location, such as the surface or another location in the well, to control operation of any or all of the actuators 18, 20, 22. The lines 54 could be electrical lines, flow lines, or any other type of lines. In addition, other methods may be used to remotely control operation of the actuators 18, 20, 22, such as acoustic or electromagnetic or pressure pulse telemetry, in keeping with the principles of the invention.

Figure 2:
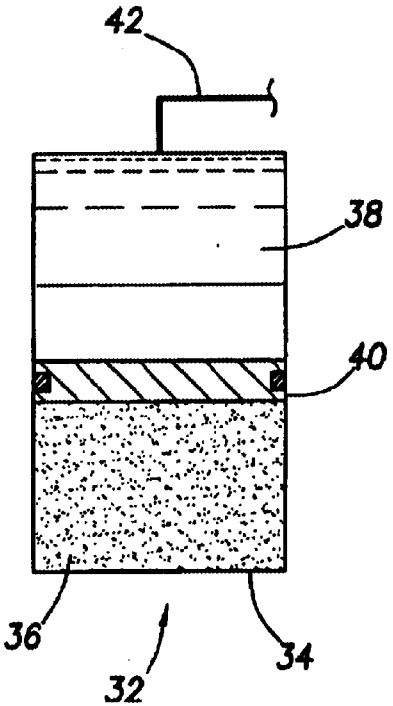
FIG. 2 is an enlarged scale cross-sectional view of a first actuator embodying principles of the present invention.

Referring additionally now to FIG. 2, an actuator 32 which embodies principles of the present invention is representatively illustrated. The actuator 32 may be used for any of the actuators 18, 20, 22 in the method 10, or it may be used in other methods.

The actuator 32 has a chamber 34 in which a gas absorptive material 36 is contained. The material 36 is separated from a reservoir of fluid, such as oil 38, by a piston 40. If the piston 40 is displaced upward, the oil 38 will be discharged out of a hydraulic line 42. The line 42 may be any of the lines 26, 28, 30 described above in the method 10.

Preferably, the gas absorptive material 36 is a metallic powder which is generically termed a metal hydride when hydrogen gas is absorbed therein. An example of such a metal hydride is Hy-Stor® alloy available from Ergenics, Inc. of Ringwood, N.J. Various other metal hydrides could also be used. Furthermore, gas absorptive materials other than metal hydrides could be used in keeping with the principles of the invention.

A useful property of metal hydrides is that they expand in volume when hydrogen gas is absorbed therein. The hydrogen gas may later be discharged from the metal hydride, in which case the metal hydride will contract in volume. This property of volume expansion and contraction of the material 36 is particularly useful in that it enables operation of the actuator 32 to be reversible, for example, to open and close valves, etc. However, this reversibility is not necessary in keeping with the principles of the invention, since an actuator may only need to be operated in one particular manner, for example, to set a packer.

In the following description of the actuator 32, and other actuators described below, the gas absorptive material will be referred to as a metal hydride, with the gas absorbed therein and/or discharged therefrom being hydrogen gas, but it is to be understood that any gas absorptive material which has the property of expanding in response to gas absorbed therein, or contracting in response to gas discharged therefrom, maybe used instead.

Figure 4:
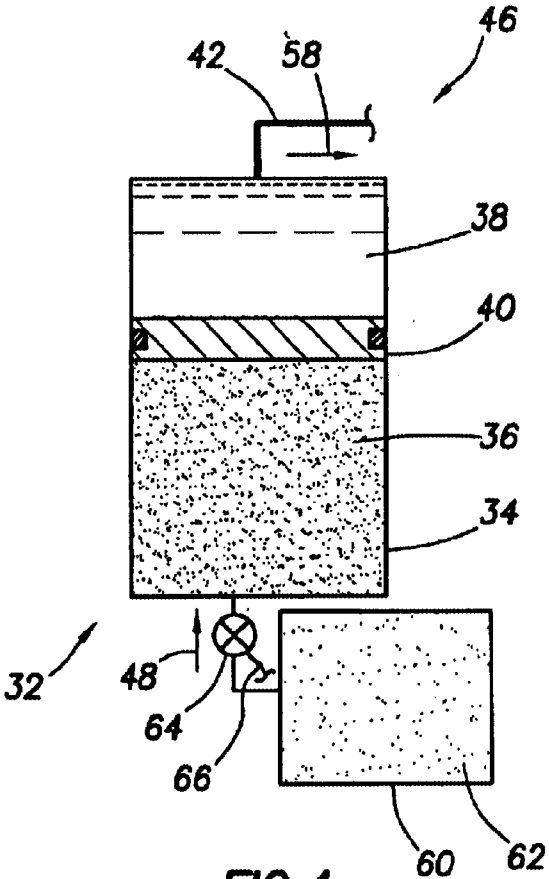
FIG. 4 is a cross-sectional view of a second method of controlling gas flow in the first actuator of FIG. 2.
Figure 3:
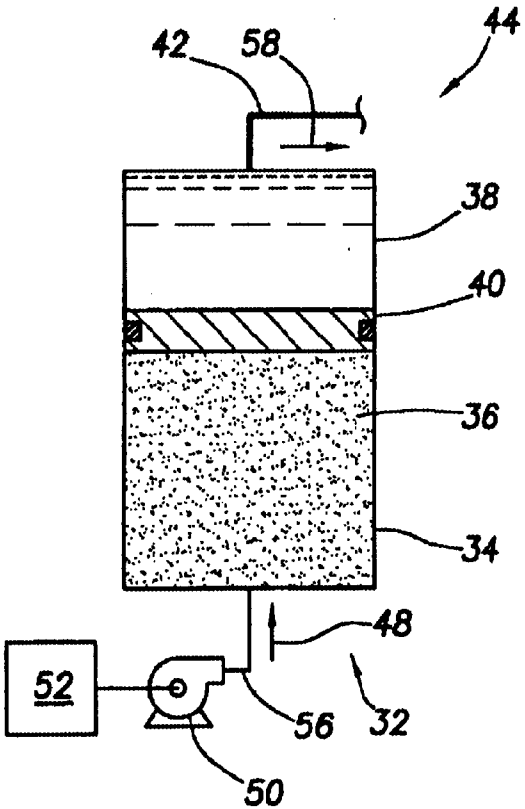
FIG. 3 is a cross-sectional view of a first method of controlling gas flow in the first actuator of FIG. 2.

As depicted in FIG. 2, the metal hydride 36 is in a depleted condition, that is, with the hydrogen gas substantially discharged therefrom. When hydrogen gas is flowed into the chamber 34, however, the metal hydride 36 will absorb the gas and expand in volume. FIGS. 3 & 4 representatively illustrate two different methods 44, 46 of flowing hydrogen gas into the chamber 34. However, other methods may be used in keeping with the principles of the invention.

Turning now to FIG. 3, it may be seen that the metal hydride 36 has absorbed hydrogen gas (indicated by arrow 48) flowed into the chamber 34. A pump 50 has been used to flow the hydrogen gas 48 from a remote gas storage device 52 to the chamber 34. The pump 50, thus, functions as a gas flow controller for controlling the flow of hydrogen gas 48 into the chamber 34.

If the actuator 32 is used in the method 10, the storage device 52 and pump 50 could be located at the surface or another remote location, with a line 56 extending between the pump and the chamber 34. In that case, the line 56 would be one of the lines 54 shown in FIG. 1. It will be readily appreciated that the transmission of a gas via the line 56 overcomes at least some of the problems associated with transmission of hydraulic fluid via control lines. For example, there is no need to compensate for the hydrostatic pressure of hydraulic fluid in the lines.

Upon absorbing the hydrogen gas 48, the metal hydride 36 has expanded, displacing the piston 40 upward. Such upward displacement of the piston 40 has caused some of the oil 38 to be discharged via the line 42 (indicated by arrow 58). This discharge of oil 38 may be used to actuate a device, such as any of the downhole tools 12, 14, 16 in the method 10.

Turning now to FIG. 4, the actuator 32 in the method 46 uses another way of controlling the flow of hydrogen gas 48 between the chamber 34 and a gas storage device 60. In this method 46, the storage device 60 is another container of a gas storing material 62, and the gas flow controller is a valve 64. The valve 64 is opened to permit hydrogen gas 48 to flow from the storage device 60 to the chamber 34.

The valve 64 may be an electrically operated valve, such as a solenoid valve. An electrical line 66 maybe used to operate the valve 64, in which case the line 66 may be one of the lines 54 in the method 10. Of course, other types of valves, and other ways of operating valves may be used, without departing from the principles of the invention. For example, the valve 64 may be a membrane positioned between the chamber 34 and the storage device 60. In that case, the membrane is opened, such as by piercing or breaking the membrane, to permit hydrogen gas 48 to flow between the storage device 60 and the chamber 34.

The gas storing material 62 in the storage device 60 is preferably a metal hydride, similar to (or the same as) the metal hydride 36 in the chamber 34. When the valve 64 is opened, hydrogen gas 48 previously stored in the material 62 flows into the chamber 34, where it is absorbed by the metal hydride 36. The metal hydride 36 expands, displacing the piston 40 upward and forcing the oil 38 to discharge via the line 42, as described above for the method 44.

Figure 8:
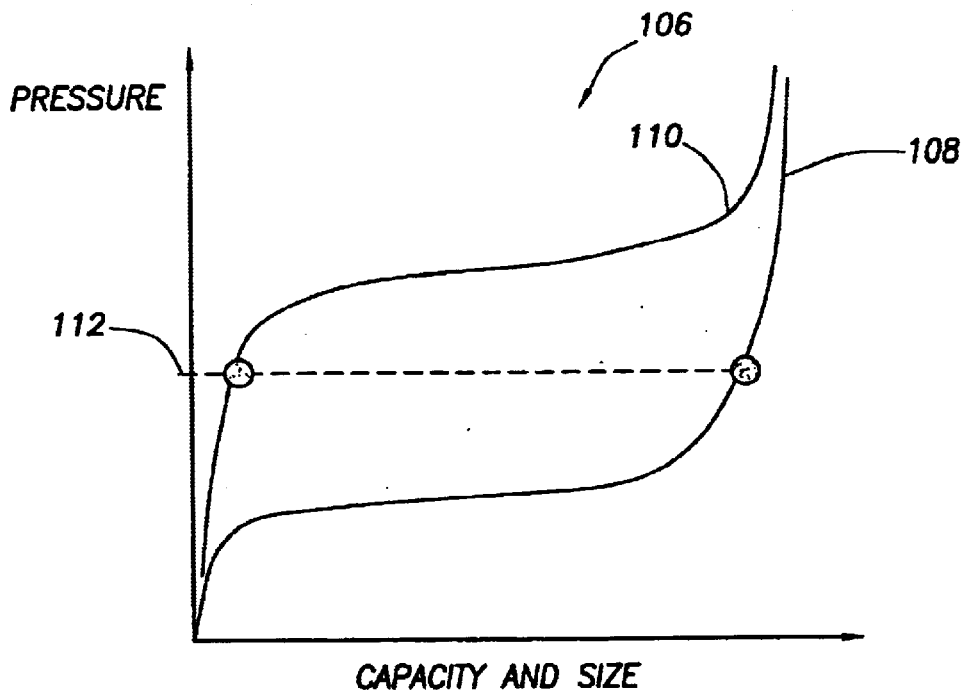
FIG. 8 is a graph of capacity and size vs. pressure for a gas absorptive material.

Various methods may be used to discharge the hydrogen gas 48 from the material 62 in the storage device 60. For example, it is well known to those skilled in the art that the capacity of a metal hydride material to absorb hydrogen gas generally decreases with increased temperature. An exemplary graph illustrating this property of metal hydrides is depicted in FIG. 8, which is described in more detail below.

Therefore, the material 62 may be heated to cause it to discharge the hydrogen gas 48. This heat may result from the storage device 60 being positioned downhole, that is, geothermal energy may be used to heat the material 62 as it is conveyed into a well. Other ways of heating the material 62 may also be used, such as electrical resistance heating, chemical heating, etc.

As mentioned above, one of the advantages of using metal hydride 36 in the actuator 32 is that its change in volume is reversible. In the method 44, the pump 50 maybe reversed to flow the hydrogen gas 48 from the chamber 34 back into the storage device 52. In the method 46, the valve 64 may be opened to permit the hydrogen gas 48 to flow from the chamber 34 back into the storage device 60, where the gas may again be absorbed by the material 62. This reverse flow of the hydrogen gas 48 in the method 46 may be accomplished by heating the metal hydride 36 in the chamber 34 while permitting the material 62 in the storage device 60 to cool.

When the hydrogen gas 48 is discharged from the metal hydride 36, the metal hydride contracts in volume. This reduction in volume permits the piston 40 to displace downward from the position shown in FIGS. 3 & 4 to the position shown in FIG. 2, thereby permitting the oil 38 to flow into the actuator 32 via the line 42. This oil flow into the actuator 32 may result in actuation of a device, such as closing of the safety valve 12 in the method 10.

Of course, the metal hydride 36 could be substantially saturated with hydrogen gas when the actuator 32 is in its initial configuration, and then the hydrogen gas could be discharged from the metal hydride to actuate a device. Thus, the metal hydride 36 could be in a substantially saturated condition, in a substantially depleted condition, or in a condition therebetween, initially and then hydrogen gas either absorbed therein or discharged therefrom to actuate a device.

In the above description of the actuator 32, the piston 40 is displaced by expansion or contraction of the metal hydride 36 to thereby flow the oil 38 to or from a device to actuate the device. However, it should be understood that expansion or contraction of the metal hydride 36 may be used to cause actuation of a device without the use of a piston or oil. For example, instead of displacing the piston 40, expansion or contraction of the metal hydride 36 may be used to displace another actuator member connected to an opening prong of a safety valve, a setting mandrel of a packer, a sliding sleeve of a production valve, etc.

As another example, it is well known in the well perforating art to displace an explosive train blocking member downhole to thereby permit explosive initiation or explosive transfer in a perforating gun assembly downhole, but to prevent such initiation or transfer at the surface. It will be readily appreciated by one skilled in the art that the actuator 32 could be used for this purpose, such as by having the metal hydride 36 in a substantially saturated condition at the surface (where the metal hydride would be at a relatively low temperature). When the actuator 32 is later positioned downhole, geothermal energy would heat the metal hydride 36, causing the metal hydride to discharge hydrogen gas and contract, thereby displacing an actuator member connected to the explosive train blocking member and permitting downhole explosive initiation or transfer.

Therefore, it is to be understood that the piston 40 is merely representative of an actuator member which may be displaced by the change in volume of the metal hydride 36 to cause actuation of a device.

Figure 5:
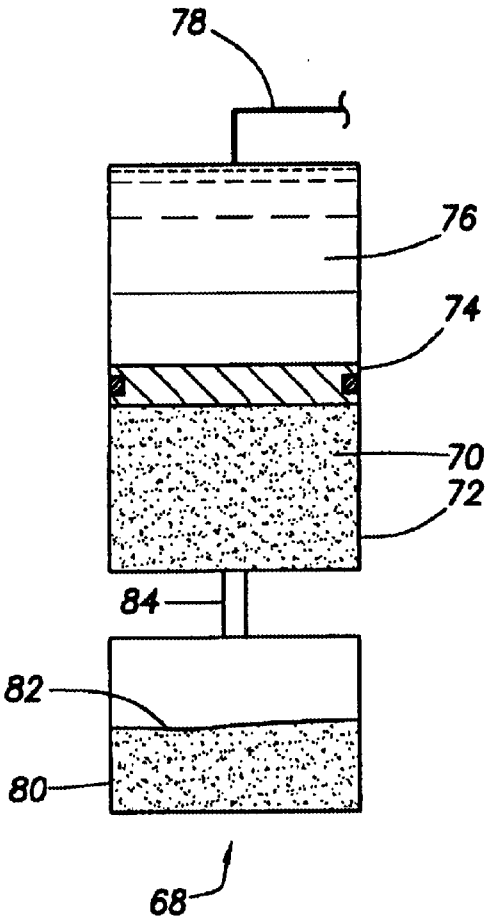
FIG. 5 is a cross-sectional view of a second actuator embodying principles of the present invention.

Referring additionally now to FIG. 5, another actuator 68 is representatively illustrated. The actuator 68 is similar in many respects to the actuator 32 described above, in that a metal hydride 70 or other gas absorptive material in a chamber 72 is used to displace a piston 74 and flow oil 76 or another fluid via a line 78 to actuate a device, such as a downhole tool. In particular, the actuator 68 is similar to the actuator 32 as depicted in FIG. 4, in that a gas storage device 80 having a metal hydride 82 or other gas storing material therein is connected to the chamber 72.

A flow line 84 provides a conduit whereby hydrogen gas may be transferred between the chamber 72 and the storage device 80. As depicted in FIG. 5, the metal hydride 70 in the chamber 72 and the metal hydride 82 in the storage device 80 are at substantially equal hydrogen absorption capacity and are at a substantially equal temperature, and so there is no flow of hydrogen gas through the flow line 84. Note that the piston 74 is at an initial position as shown in FIG. 5.

Figure 7:
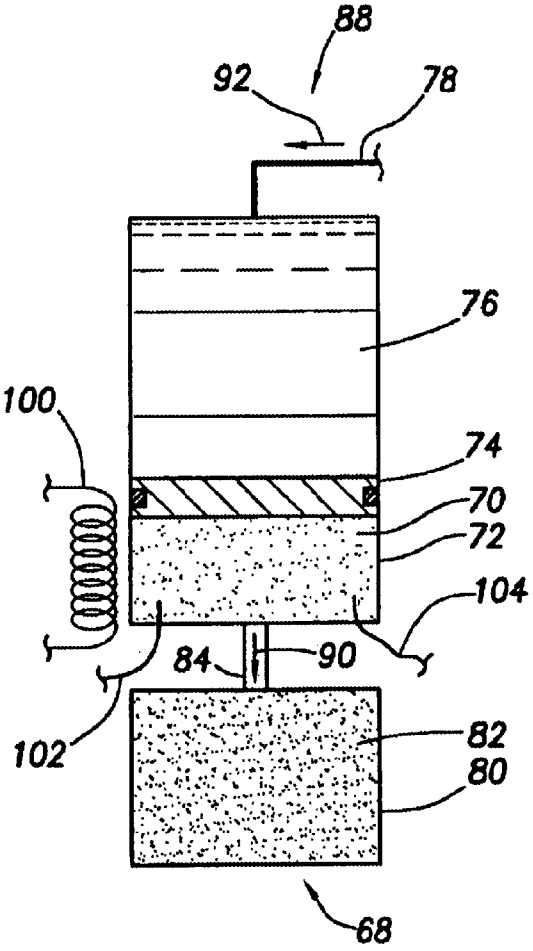
FIG. 7 is a cross-sectional view of a second method of controlling gas flow in the second actuator of FIG. 5.
Figure 6:
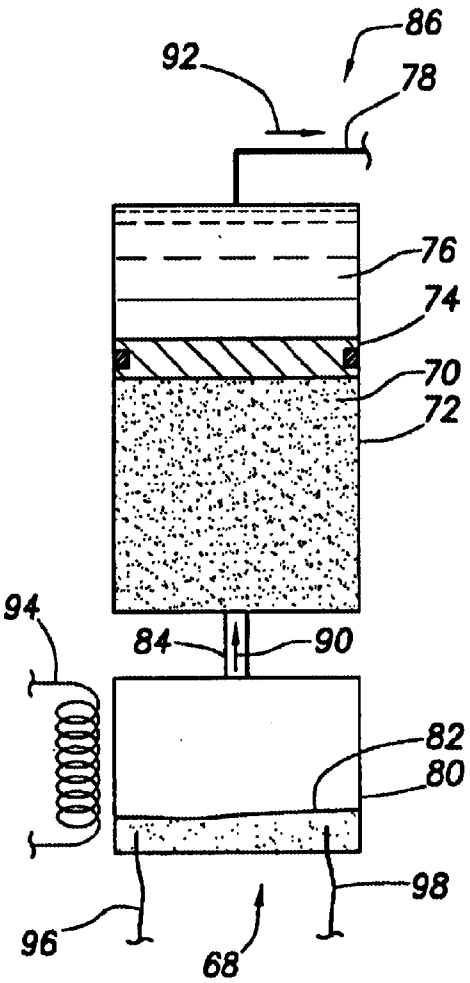
FIG. 6 is a cross-sectional view of a first method of controlling gas flow in the second actuator of FIG. 5.

One method 86 of operating the actuator 68 is representatively illustrated in FIG. 6, and another method of operating the actuator is representatively illustrated in FIG. 7. In FIG. 6, the metal hydride 82 in the storage device 80 is heated, causing the metal hydride 82 to discharge the hydrogen gas (indicated by arrow 90). The hydrogen gas go flows from the storage device 80 to the chamber 72, where it is absorbed by the metal hydride 70 therein.

When the metal hydride 70 in the chamber 72 absorbs the hydrogen gas 90, it expands and forces the piston 74 upward. Upward displacement of the piston 74 displaces the oil 76 out of the actuator 68 via the line 78 (the oil flow being indicated by arrow 92). This oil flow 92 may be used to operate a device, such as any of the downhole tools 12, 14, 16 in the method 10.

Heating of the metal hydride 82 in the storage device 80 may be accomplished by any of a variety of ways. For example, an electrical resistance heating element 94 may be used to heat the metal hydride 82. As another example, since the material 82 is metallic, an electric current may be passed through the material via lines 96, 98 to heat the material. Other heating devices may be used in keeping with the principles of the invention.

In FIG. 7, heat is applied to the metal hydride 70 in the chamber 72, thereby causing the metal hydride to discharge the hydrogen gas go therefrom. The hydrogen gas 90 flows from the chamber 72 into the storage device 80, where it is absorbed by the metal hydride 82. When the hydrogen gas go is discharged from the metal hydride 70, it contracts and the piston 74 is permitted to displace downward. Downward displacement of the piston 74 permits the oil 76 to flow into the actuator 68, thereby actuating a device, such as any of the downhole tools 12, 14, 16 in the method 10.

The metal hydride 70 may be heated in any manner, such as those described above for the method 86. As depicted in FIG. 7, an electrical resistance heater 100 may be used, or lines 102, 104 may be used to pass electrical current through the metal hydride 70. Note that the heater 100 may be the same as the heater 94, in which case the heater's position may merely be changed to operate the actuator 68 using the method 86 or using the method 88 as desired. Similarly, electrical current may be switched between the lines 96, 98 and the lines 102, 104 to operate the actuator 68 using the method 86 or using the method 88 as desired.

Therefore, it will be readily appreciated that the piston 74 may be displaced alternately between its positions as shown in FIGS. 6 & 7 by applying heat alternately to the metal hydride 70 in the chamber 72, and to the metal hydride 82 in the storage device 80. The alternate upward and downward displacement of the piston 74 may be used to produce corresponding alternate actuation of a device, such as, to alternately open and close a valve, to alternately set and unset a packer, etc.

Referring additionally now to FIG. 8, a graph 106 of capacity and size vs. pressure for a gas absorptive material is representatively illustrated. The graph 106 is typical for a metal hydride alloy, but it should be understood that the graph is not characteristic of all metal hydride alloys, other metal hydride alloys having other capacity and size vs. pressure relationships may be used, and other gas absorptive materials may be used, in actuators incorporating principles of the invention.

The graph 106 includes two capacity and size vs. pressure curves—one curve 108 at a relatively low temperature, and another curve 110 at a relatively high temperature. The vertical "pressure" axis indicates the pressure of gas (the hydrogen gas absorbed by the metal hydride). The horizontal "capacity & size" axis indicates the capacity (i.e., volume) of hydrogen gas absorbed by the metal hydride, and the size (i.e., volume) of the metal hydride.

Note that, for a given pressure 112, when going from a relatively low temperature to a relatively high temperature, the gas absorption capacity of the metal hydride is reduced (hydrogen gas is discharged by the metal hydride) and the size of the metal hydride is reduced (the metal hydride volume contracts). This process is reversible so that, when going from a relatively high temperature to a relatively low temperature, the gas absorption capacity of the metal hydride is increased (additional hydrogen gas is absorbed by the metal hydride) and the size of the metal hydride is increased (the metal hydride volume expands).

This property is depicted in FIGS. 6 & 7 and its use is described above in the actuator 68. When the metal hydride 82 in the storage device 80 is heated to a relatively high temperature (FIG. 6), it discharges hydrogen gas 90, which is absorbed by the metal hydride 70 at a relatively low temperature in the chamber 72, resulting in expansion of the metal hydride 70. When the metal hydride 70 in the chamber 72 is heated to a relatively high temperature (FIG. 7), it discharges hydrogen gas 90, which is absorbed by the metal hydride 82 at a relatively low temperature in the storage device 80, resulting in contraction of the metal hydride 70.

Figure 9:
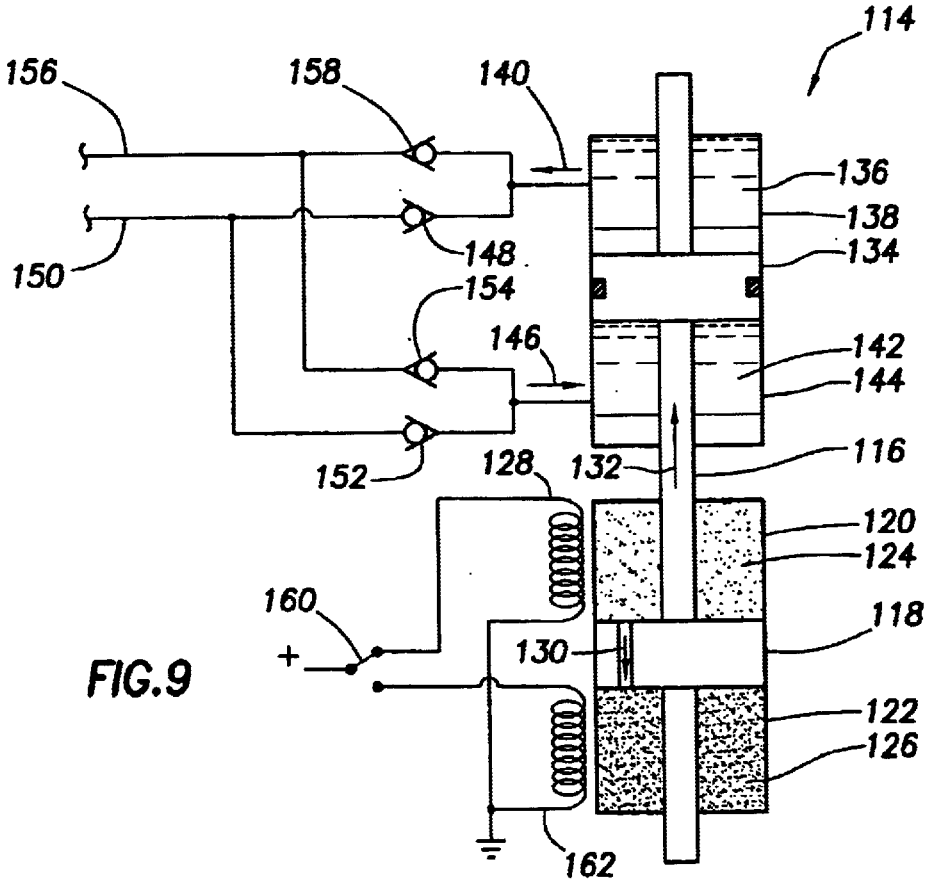
FIG. 9 is a cross-sectional view of a third actuator embodying principles of the present invention.

Referring additionally now to FIG. 9, another actuator 114 embodying principles of the invention is representatively illustrated. The actuator 114 uses the property of gas absorptive materials described above in relation to FIG. 8, but in a somewhat different manner compared to how it is used in the actuator 68. In the actuator 114, gas absorptive material is positioned on opposing sides of an actuator member, so that the member is displaced in one direction when the gas absorptive material on one side of the member is expanded, and the member is displaced in a different direction when the gas absorptive material on the other side of the member is expanded.

Specifically, the actuator 114 includes a mandrel 116 on which is formed an enlarged section 118. Above the enlarged section 118 is a chamber 120, and below the enlarged section is another chamber 122. A metal hydride 124 or other gas absorptive material is contained in the upper chamber 120, and another metal hydride 126 or other gas absorptive material is contained in the lower chamber 122. The metal hydrides 124, 126 may actually be the same type of material.

As depicted in FIG. 9, the metal hydride 124 in the upper chamber 120 is being heated by use of an electrical resistance heater 128. This heating of the metal hydride 124 is causing it to discharge hydrogen gas (indicated by arrow 130), which flows into the lower chamber 122 via a passage formed through the enlarged section 118. As a result, the metal hydride 124 in the upper chamber 120 contracts in volume while the metal hydride 126 in the lower chamber 122 expands in volume.

As the metal hydride 126 in the lower chamber 122 expands, it bears on the enlarged section 118 and forces the mandrel 116 to displace upwardly (as indicated by arrow 132). A piston 134 is attached to the mandrel 116 so that, as the mandrel displaces upwardly, the piston also displaces upwardly. Such upward displacement of the piston 134 forces a fluid, such as oil 136, in a cylinder 138 above the piston to flow outwardly (as indicated by arrow 140). The upward displacement of the piston 134 also draws a fluid, such as oil 142, into a cylinder 144 below the piston (as indicated by arrow 146).

A check valve 148 permits the outward oil flow 140 to pass to a fluid delivery line 150, while a check valve 152 prevents the flow 140 from passing into the lower cylinder 144. A check valve 154 permits the inward oil flow 146 to pass from a fluid return line 156 to the lower cylinder 144, while a check valve 158 prevents the outward oil flow 140 from passing to the fluid return line. Thus, as the piston 134 displaces upwardly, fluid is discharged from the upper cylinder 138 to the delivery line 150 while fluid is drawn into the lower cylinder 144 from the return line 156.

An electrical switch 160 may be used to apply electrical power to another resistance heater 162 in order to heat the metal hydride 126 in the lower chamber 122. Note that, when electrical power is applied to the lower heater 162, it is also removed from the upper heater 128. Preferably, both of the chambers 120, 122 are not heated at the same time.

As the metal hydride 126 in the lower chamber 122 is heated, the metal hydride 124 in the upper chamber 120 cools. Hydrogen gas flows from the lower chamber 122 to the upper chamber 120 (in a direction opposite to that indicated by arrow 130), the metal hydride 126 in the lower chamber contracts, and the metal hydride 124 in the upper chamber 120 expands. Expansion of the metal hydride 124 in the upper chamber 120 causes it to bear on the enlarged section 118 and force the mandrel 116 downwardly (in a direction opposite to that indicated by arrow 132).

Downward displacement of the mandrel 116 produces downward displacement of the piston 134. As the piston 134 displaces downwardly, oil 136 is drawn into the upper cylinder 138 (in a direction opposite to that indicated by arrow 140) and oil 142 is displaced outwardly from the lower cylinder 144 (in a direction opposite to that indicated by arrow 146).

The check valve 158 permits the oil 136 to flow from the return line 156 to the upper cylinder 138, while the check valve 148 prevents the oil from being drawn into the upper cylinder from the delivery line 150 or from the lower cylinder 144. The check valve 152 permits the oil 142 to flow from the lower cylinder 144 to the delivery line 150, while the check valve 154 prevents the oil from flowing to the return line 156. Thus, while the piston 134 displaces downwardly, fluid is discharged from the lower cylinder 144 to the delivery line 150 while fluid is drawn into the upper cylinder 138 from the return line 156.

Therefore, fluid is discharged from the actuator 114 to the delivery line 150 both while the piston 134 is displacing upwardly and while it is displacing downwardly, and fluid is received into the actuator from the return line 156 both while the piston is displacing upwardly and while it is displacing downwardly. It will be readily appreciated that this feature of the actuator 114 may be useful in actuating a variety of devices, such as the sliding sleeve valve 16 in the method 10. For example, upward displacement of the piston 134 may be used to open the valve 16 and downward displacement of the piston maybe used to close the valve.

This feature of the actuator 114 may also be used to actuate devices which are operated in response to fluid flow, or to otherwise pump fluid from one location to another, or to otherwise circulate fluid from the delivery line 150 to the return line 156. Specifically, the actuator 114 may be operated as a pump by repeatedly alternating the application of heat to the metal hydrides 124, 126, so that the mandrel 116 is repeatedly reciprocated alternately upwardly and downwardly. In this way, fluid may be flowed repeatedly into the delivery line 150 from the actuator 114 and fluid may be received repeatedly from the return line 156 into the actuator.

Other methods of heating the metal hydrides 124, 126 maybe used instead of the heaters 128, 162. For example, the metal hydrides 124, 126 may be heated by passing electrical current therethrough, or by chemical heating, etc.

Note that the arrangement of the piston 134, cylinders 138, 144 and check valves 148, 152, 154, 158 may also be used with the other actuators 32, 68 described above. In this way, the other actuators 32, 68 may also be used to pump fluid between the delivery and return lines 150, 156.

Furthermore, note that in the actuator 114, each of the chambers 120, 122 and respective metal hydrides 124, 126 therein acts as a gas storage device for the other. That is, hydrogen gas used to expand the metal hydride 124 in the chamber 120 is stored in the metal hydride 126 in the chamber 122 until it is needed. Likewise, hydrogen gas used to expand the metal hydride 126 in the chamber 122 is stored in the metal hydride 124 in the chamber 120 until it is needed.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. An actuator for a downhole tool, the actuator comprising:

a chamber having a metal hydride material disposed therein;

a hydrogen storage device; and a hydrogen flow controller controlling flow of hydrogen between the hydrogen storage device and the chamber, thereby controlling actuation of the downhole tool, the flow controller including a valve device selectively permitting and preventing hydrogen flow between the hydrogen storage device and the chamber.

2. The actuator according to claim 1, wherein the flow controller causes hydrogen to flow from the hydrogen storage device into the chamber, thereby causing the metal hydride material to expand and actuate the downhole tool.

3. The actuator according to claim 1, wherein the valve device includes a membrane preventing flow from the hydrogen storage device to the chamber, the membrane being opened to permit hydrogen flow from the hydrogen storage device to the chamber.

4. The actuator according to claim 1, wherein the flow controller admits hydrogen flow from the chamber into the hydrogen storage device, thereby causing the metal hydride material to contract and actuate the downhole tool.

5. The actuator according to claim 4, wherein the flow controller heats the metal hydride material in the chamber, thereby discharging hydrogen from the metal hydride material and causing hydrogen to flow to the hydrogen storage device.

6. The actuator according to claim 5, wherein the flow controller heats the metal hydride material by passing electrical current through the metal hydride material.

7. The actuator according to claim 1, further comprising a piston, the piston displacing in response to at least one of expansion and contraction of the metal hydride material.

8. The actuator according to claim 7, wherein the piston displaces in response to absorption of hydrogen by the metal hydride material.

9. The actuator according to claim 7, wherein the piston displaces in response to discharge of hydrogen from the metal hydride material.

10. An actuator for a downhole tool, the actuator comprising:

a chamber having a metal hydride material disposed therein;

a hydrogen storage device; and a hydrogen flow controller controlling flow of hydrogen between the hydrogen storage device and the chamber, thereby controlling actuation of the downhole tool, wherein the flow controller causes hydrogen to flow from the hydrogen storage device into the chamber, thereby causing the metal hydride material to expand and actuate the downhole tool, and wherein the flow controller heats a hydrogen storing material in the hydrogen storage device, thereby discharging hydrogen from the hydrogen storing material and causing hydrogen to flow to the chamber.

11. The actuator according to claim 10, wherein the flow controller heats the metal hydride material by passing electrical current through the metal hydride material.

12. An actuator for a downhole tool, the actuator comprising:

a chamber having a metal hydride material disposed therein;

a hydrogen storage device; and a hydrogen flow controller controlling flow of hydrogen between the hydrogen storage device and the chamber, thereby controlling actuation of the downhole tool, wherein the flow controller causes hydrogen to flow from the hydrogen storage device into the chamber, thereby causing the metal hydride material to expand and actuate the downhole tool, and wherein the flow controller includes a pump which pumps hydrogen from the hydrogen storage device into the chamber.

13. An actuator for a downhole tool, the actuator comprising:

a chamber having a metal hydride material disposed therein;

a piston, the piston displacing in response to at least one of expansion and contraction of the metal hydride material;

a hydrogen storage device; and a hydrogen flow controller controlling flow of hydrogen between the hydrogen storage device and the chamber, thereby controlling actuation of the downhole tool, wherein displacement of the piston causes displacement of a fluid between the actuator and the downhole tool, the downhole tool being actuated in response to the fluid displacement.

14. An actuator for a downhole tool, the actuator comprising:

a chamber having a metal hydride material disposed therein;

a piston, the piston displacing in response to at least one of expansion and contraction of the metal hydride material;

a hydrogen storage device; and a hydrogen flow controller controlling flow of hydrogen between the hydrogen storage device and the chamber, thereby controlling actuation of the downhole tool, wherein the piston is displaced repeatedly in alternating directions, thereby pumping fluid between the actuator and the downhole tool.

15. An actuator for a downhole tool, the actuator comprising:

an actuator member which is displaceable to actuate the downhole tool;

a chamber having a gas absorptive material disposed therein, the gas absorptive material changing volume in response to a change in volume of gas absorbed therein, and the actuator member being displaced by the gas absorptive material as the volume of the gas absorptive material changes;

a gas storage device; and a gas flow controller controlling flow of gas between the gas storage device and the chamber, whereby the downhole tool is actuated in response to the change in volume of the gas absorptive material.

16. The actuator according to claim 15, wherein the gas absorptive material is a metal hydride.

17. The actuator according to claim 15, wherein the gas absorptive material absorbs hydrogen gas.

18. The actuator according to claim 15, wherein the flow controller admits gas flow from the gas storage device into the chamber, thereby causing the gas absorptive material to expand and actuate the downhole tool.

19. The actuator according to claim 15, wherein the flow controller admits gas flow from the chamber into the gas storage device, thereby causing the gas absorptive material to contract and actuate the downhole tool.

20. The actuator according to claim 19, wherein the flow controller heats the gas absorptive material in the chamber, thereby discharging gas from the gas absorptive material and causing gas to flow to the gas storage device.

21. The actuator according to claim 20, wherein the flow controller heats the gas absorptive material by passing electrical current through the gas absorptive material.

22. The actuator according to claim 15, wherein the actuator member is a piston, the piston displacing in response to at least one of expansion and contraction of the gas absorptive material.

23. The actuator according to claim 22, wherein the piston displaces in response to absorption of gas by the gas absorptive material.

24. The actuator according to claim 22, wherein the piston displaces in response to discharge of gas from the gas absorptive material.

25. An actuator for a downhole tool, the actuator comprising:

a chamber having a gas absorptive material disposed therein, the gas absorptive material changing volume in response to a change in volume of gas absorbed therein;

a gas storage device; and a gas flow controller controlling flow of gas between the gas storage device and the chamber, whereby the downhole tool is actuated in response to the change in volume of the gas absorptive material, wherein the flow controller admits gas flow from the gas storage device into the chamber, thereby causing the gas absorptive material to expand and actuate the downhole tool, and wherein the flow controller heats a gas storing material in the gas storage device, thereby discharging gas from the gas storing material and causing gas to flow to the chamber.

26. The actuator according to claim 25, wherein the flow controller heats the gas storing material by passing electrical current through the gas storing material.

27. An actuator for a downhole tool, the actuator comprising:

a chamber having a gas absorptive material disposed therein, the gas absorptive material changing volume in response to a change in volume of gas absorbed therein;

a gas storage device; and a gas flow controller controlling flow of gas between the gas storage device and the chamber, whereby the downhole tool is actuated in response to the change in volume of the gas absorptive material, wherein the flow controller admits gas flow from the gas storage device into the chamber, thereby causing the gas absorptive material to expand and actuate the downhole tool, and wherein the flow controller includes a valve device selectively permitting and preventing gas flow between the gas storage device and the chamber.

28. The actuator according to claim 27, wherein the valve device includes a membrane separating the gas storage device from the chamber, the membrane being opened to permit gas flow from the gas storage device to the chamber.

29. An actuator for a downhole tool, the actuator comprising:

a chamber having a gas absorptive material disposed therein, the gas absorptive material changing volume in response to a change in volume of gas absorbed therein;

a gas storage device; and a gas flow controller controlling flow of gas between the gas storage device and the chamber, whereby the downhole tool is actuated in response to the change in volume of the gas absorptive material, wherein the flow controller admits gas flow from the gas storage device into the chamber, thereby causing the gas absorptive material to expand and actuate the downhole tool, and wherein the flow controller includes a pump which pumps gas from the gas storage device into the chamber.

30. An actuator for a downhole tool, the actuator comprising:

a chamber having a gas absorptive material disposed therein, the gas absorptive material changing volume in response to a change in volume of gas absorbed therein;

a piston which displaces in response to at least one of expansion and contraction of the gas absorptive material;

a gas storage device; and a gas flow controller controlling flow of gas between the gas storage device and the chamber, whereby the downhole tool is actuated in response to the change in volume of the gas absorptive material, and wherein displacement of the piston causes displacement of a fluid between the actuator and the downhole tool, the downhole tool being actuated in response to the fluid displacement.

31. An actuator for a downhole tool, the actuator comprising:

a chamber having a gas absorptive material disposed therein, the gas absorptive material changing volume in response to a change in volume of gas absorbed therein;

a piston which displaces in response to at least one of expansion and contraction of the gas absorptive material;

a gas storage device; and a gas flow controller controlling flow of gas between the gas storage device and the chamber, whereby the downhole tool is actuated in response to the change in volume of the gas absorptive material, and wherein the piston is displaced repeatedly in alternating directions, thereby pumping fluid between the actuator and the downhole tool.

32. A method of actuating a downhole tool, the method comprising the steps of:

connecting the downhole tool to an actuator including a gas absorptive material disposed in a chamber;

positioning the actuator and downhole tool in a wellbore;

altering a volume of gas absorbed by the gas absorptive material, thereby changing a volume of the gas absorptive material; and actuating the downhole tool in response to the gas absorptive material changing volume.

33. The method according to claim 32, wherein the actuating step further includes displacing fluid between the actuator and the downhole tool in response to the gas absorptive material changing volume.

34. The method according to claim 33, wherein the fluid displacing step further includes displacing a piston of the actuator in response to the gas absorptive material changing volume.

35. The method according to claim 33, wherein the actuating step further comprises alternately expanding and contracting the gas absorptive material volume, thereby pumping fluid repeatedly between the actuator and the downhole tool.

36. The method according to claim 32, wherein the altering step further comprises controlling gas flow between the chamber and a gas storage device utilizing a gas flow controller.

37. The method according to claim 36, wherein the controlling step further comprises operating a valve of the gas flow controller to selectively permit and prevent gas flow between the chamber and a gas storage device.

38. The method according to claim 37, wherein the controlling step further comprises positioning a membrane of the gas flow controller so that gas flow between the chamber and the gas storage device is prevented, and then opening the membrane to permit gas flow therethrough.

39. The method according to claim 37, wherein the controlling step further comprises heating the gas absorptive material, thereby discharging gas from the gas absorptive material.

40. The method according to claim 39, wherein the heating step further comprises passing electrical current through the gas absorptive material.

41. The method according to claim 36, wherein the controlling step further comprises heating a gas storing material in the gas storage device, thereby discharging gas from the gas storing material.

42. The method according to claim 41, wherein the heating step further comprises passing electrical current through the gas storing material.

43. The method according to claim 41, wherein the controlling step further comprises heating the gas absorptive material, thereby discharging gas from the gas absorptive material.

44. The method according to claim 43, wherein the controlling step further comprises alternately performing the gas storing material heating and gas absorptive material heating steps.

45. The method according to claim 44, wherein the controlling step further comprises repeatedly alternately performing the gas storing material heating and gas absorptive material heating steps, thereby pumping fluid between the actuator and the downhole tool in the actuating step.

46. A method of actuating a downhole tool, the method comprising the steps of:

providing an actuator including a gas absorptive material;

connecting the actuator to the downhole tool;

heating the gas absorptive material downhole, thereby causing the gas absorptive material to discharge gas; and actuating the downhole tool in response to the gas absorptive material discharging gas.

47. The method according to claim 46, wherein the heating step is performed by positioning the actuator downhole, the gas absorptive material being heated by geothermal energy.

48. The method according to claim 46, wherein the heating step is performed by passing electrical current through the gas absorptive material.

49. The method according to claim 46, wherein the heating step further comprises reducing a volume of the gas absorptive material due to the gas absorptive material discharging gas.

50. The method according to claim 46, wherein the actuating step further comprises displacing a member of the actuator.

51. The method according to claim 50, wherein in the displacing step, the member is a piston of the actuator.

52. The method according to claim 50, wherein the displacing step further comprises displacing a fluid between the actuator and the downhole tool.

53. The method according to claim 50, wherein in the displacing step, the actuator member is connected to a packer setting member.

54. The method according to claim 50, wherein in the displacing step, the actuator member is connected to a valve operating member.

55. The method according to claim 46, further comprising the step of actuating the downhole tool in response to the gas absorptive material absorbing gas.

56. The method according to claim 55, wherein the absorbing step further comprises expanding a volume of the gas absorptive material.

57. An actuator system, comprising:

an actuator including:

a chamber;

a gas absorptive material in the chamber; and a member which is displaced by the gas absorptive material in response to at least one of expansion and contraction of the gas absorptive material.

58. The actuator system according to claim 57, wherein the actuator member is a piston, and wherein displacement of the piston causes fluid displacement.

59. The actuator system according to claim 58, wherein displacement of the piston due to contraction of the gas absorptive material causes fluid displacement into the actuator.

60. The actuator system according to claim 58, wherein displacement of the piston due to expansion of the gas absorptive material causes fluid displacement out of the actuator.

61. The actuator system according to claim 57, further comprising a downhole tool connected to the actuator and operated by displacement of the actuator member.

62. The actuator system according to claim 57, wherein the actuator further comprises a gas storage device, and a gas flow controller operative to control flow between the gas storage device and the chamber.

63. The actuator system according to claim 62, wherein the gas flow controller discharges gas from the gas absorptive material by heating the gas absorptive material.

64. The actuator system according to claim 62, wherein the gas flow controller discharges gas from the gas absorptive material by passing electrical current through the gas absorptive material.

65. An actuator system, comprising:

an actuator including:

a chamber;

a gas absorptive material in the chamber;

a gas storage device;

a gas flow controller operative to control flow between the gas storage device and the chamber; and a member which is displaced in response to at least one of expansion and contraction of the gas absorptive material, wherein the gas flow controller includes a valve for selectively permitting and preventing gas flow between the chamber and the gas storage device.

66. An actuator system, comprising:

an actuator including:

a chamber;

a gas absorptive material in the chamber;

a gas storage device;

a gas flow controller operative to control flow between the gas storage device and the chamber; and a member which is displaced in response to at least one of expansion and contraction of the gas absorptive material, wherein the gas storage device includes a gas storing material.

67. The actuator system according to claim 66, wherein the gas flow controller heats the gas storing material to discharge gas from the gas storing material and into the chamber.

* * * * *